US012655744B2

(12) United States Patent
Göthberg et al.

(10) Patent No.: US 12,655,744 B2
(45) Date of Patent: Jun. 16, 2026

(54) METHOD AND SYSTEM FOR DETECTING A STATE OF A JOINT OF A DRILL STRING

(71) Applicant: EPIROC ROCK DRILLS AKTIEBOLAG, Örebro (SE)

(72) Inventors: Mattias Göthberg, Örebro (SE); Samuel Enblom, Örebro (SE)

(73) Assignee: EPIROC ROCK DRILLS AKTIEBOLAG, Örebro (SE)

( * ) Notice: Subject to any disclaimer, the term of this patent is extended or adjusted under 35 U.S.C. 154(b) by 425 days.

(21) Appl. No.: 18/257,137

(22) PCT Filed: Nov. 30, 2021

(86) PCT No.: PCT/SE2021/051188
§ 371 (c)(1),
(2) Date: Jun. 13, 2023

(87) PCT Pub. No.: WO2022/139655
PCT Pub. Date: Jun. 30, 2022

(65) Prior Publication Data

US 2024/0102377 A1 Mar. 28, 2024

(30) Foreign Application Priority Data

Dec. 21, 2020 (SE) ..... 2051525-0

(51) Int. Cl.
*E21B 47/007* (2012.01)
*E21B 1/02* (2006.01)

(52) U.S. Cl.
CPC ..... *E21B 47/007* (2020.05); *E21B 1/02* (2013.01)

(58) Field of Classification Search
CPC ..... E21B 47/007; E21B 1/02
See application file for complete search history.

(56) References Cited

U.S. PATENT DOCUMENTS

2007/0007040 A1 1/2007 Bergstrand et al.
2008/0056067 A1* 3/2008 Jogi ..... E21B 47/16 702/9

(Continued)

FOREIGN PATENT DOCUMENTS

CN 110455919 A 11/2019
CN 110593327 A 12/2019

(Continued)

OTHER PUBLICATIONS

International Search Report and Written Opinion mailed Mar. 16, 2022 for International Application No. PCT/SE2021/051188, 12 pages.

(Continued)

*Primary Examiner* — Elias Desta
(74) *Attorney, Agent, or Firm* — Sage Patent Group

(57) ABSTRACT

The present invention relates to a method for determining state of at least one joint of a drill string of a drill rig, the drill rig including a percussion device for inducing shock waves into the drill string, and a sensor for sensing stress waves in the drill string caused by impacts of the percussive device, the method comprising, when a stress wave is induced into the drill string by the percussive device: determining a representation of the incident stress wave caused by the percussive device; determining a representation of a reflected wave representing a reflection of the incident stress; estimating a stiffness of the at least one joint by estimating a force exerted on the at least one joint by the incident wave.

16 Claims, 7 Drawing Sheets

(56) References Cited

U.S. PATENT DOCUMENTS

| | | | | |
|---|---|---|---|---|
| 2013/0036812 | A1 | 2/2013 | Pirinen et al. | |
| 2013/0048378 | A1 | 2/2013 | Pirinen et al. | |
| 2016/0053545 | A1* | 2/2016 | Holtz | E21B 28/00 175/50 |
| 2019/0293400 | A1* | 9/2019 | Pierbattista | F42D 3/04 |
| 2020/0080411 | A1 | 3/2020 | Hamalainen | |

FOREIGN PATENT DOCUMENTS

| | | | |
|---|---|---|---|
| EP | 1671011 | B1 | 8/2010 |
| EP | 2416149 | A1 | 2/2012 |
| EP | 2567058 | A1 | 3/2013 |
| EP | 2811110 | A1 | 12/2014 |
| EP | 3266975 | A1 | 1/2018 |
| EP | 3617441 | A1 | 3/2020 |
| JP | 3636501 | B2 | 4/2005 |
| SE | 524767 | C2 | 9/2004 |
| SE | 540205 | C2 | 5/2018 |
| WO | 2005033468 | A1 | 4/2005 |
| WO | 2007082997 | A1 | 7/2007 |
| WO | 2011138510 | A1 | 11/2011 |
| WO | 2016202369 | A1 | 12/2016 |
| WO | 2020040758 | A1 | 2/2020 |

OTHER PUBLICATIONS

Office Action, Chinese Patent Application No. 202180081718.6, mailed Aug. 1, 2025, 6 pages.

* cited by examiner

METHOD AND SYSTEM FOR DETECTING A STATE OF A JOINT OF A DRILL STRING

CROSS-REFERENCE TO RELATED APPLICATIONS

This application is a 35 U.S.C. § 371 national stage application for International Application No. PCT/SE2021/051188, entitled "METHOD AND SYSTEM FOR DETECTING A STATE OF A JOINT OF A DRILL STRING", filed on Nov. 30, 2021, which claims priority to Swedish Patent Application No. 2051525-0, filed on Dec. 21, 2020, the disclosures and contents of which are hereby incorporated by reference in their entireties.

FIELD OF THE INVENTION

The present invention relates to mining, and, more specifically, to a method and system for detecting a state of a joint of a drill string. The invention also relates to a computer program implementing the method according to the invention.

BACKGROUND OF THE INVENTION

Rock drilling rigs may be used in a number of areas of application. For example, rock drilling rigs may be utilised in tunnelling, surface mining, underground mining, rock reinforcement, raise boring, and be used e.g. for drilling blast holes, grout holes, holes for installing rock bolts, water wells and other wells, piling and foundations drilling etc. There is hence a vast use for rock drilling rigs.

The actual breaking of the rock is oftentimes carried out by a drill bit contacting the rock, where the drill bit is connected to a drilling machine, in general by means of a drill string. The drilling can be accomplished in various ways, and e.g. be of a percussive type, where, for example, a percussion element, e.g. in the form of a percussion piston, of a drilling machine repeatedly strikes the drill bit, oftentimes by striking a drill string connecting the drill bit to the drilling machine, to transfer percussive pulses in the form of shock waves, i.e. stress waves, to the drill bit and further into the rock. Percussive drilling may be combined with rotation in order to obtain a drilling where buttons, inserts, of the drill bit strikes fresh rock at each stroke, thereby increasing the efficiency of the drilling.

The drill bit may be pressed against the rock by means of a feed force during drilling to ensure that as much impact energy as possible from the percussion device is transmitted to the rock.

In order to obtain an efficient percussion drilling process, it is important that the various drilling parameters are set such that the percussive drilling is carried out in a way that allows as much as possible of the shock wave energy being induced by the impact element is transferred into the rock for breaking thereof. In case the drill bit is not firmly pressed against the rock the energy may be reflected to an undesirable extent and return to the drilling machine to potentially cause excessive wear or damage. This is also the case if the joints of the drill string, in general threaded joints, are not sufficiently tightened. Harmful reflections may also occur in case the shock wave energy is too low in relation to the force by means of which the drill string is pressed against the rock.

When drilling longer holes in, for example, rock, a plurality of drill rods may be joined e.g. by being screwed together in order to lengthen the drill string so that a hole of a desired length may be drilled.

SUMMARY OF THE INVENTION

It is an object of the invention to provide a method and system that may identify loosened joints, in particular loosened threaded joints, during percussive drilling.

According to the invention, it is provided a method for determining the state of at least one joint of a drill string of a drill rig, the drill rig comprising a percussion device comprising a percussive element for inducing shock waves into the drill string, and a sensor for sensing stress waves in the drill string caused by impacts of the percussive element, the method comprising, when a stress wave is induced into the drill string by the percussive element. A representation of the incident stress wave caused by the percussive element is determined, as is a representation of a reflected wave representing a reflection of the incident stress when reaching said at least one joint.

A stiffness of the at least one joint is estimated by estimating a force exerted on the at least one joint by said incident wave and a displacement caused by said force, and a signal representing the state of said at least one joint is generated based on said estimated stiffness.

As discussed above, properly tightened joints are a requirement for efficient drilling. The tightening of the normally threaded joints in general also becomes firm as a consequence of the shock waves passing through the joints during drilling. In unfavourable conditions, however, the joints may become loosened which deteriorates the drilling and the threaded joints are subject to excessive wear.

There are also situations when there exists a desire to loosen the joints. Following drilling of a hole the drill string is retracted and the drill rods loosened from each other. During drilling, however, the joints may become so firmly tightened as a consequence of the shock waves passing the joints during drilling that the joints cannot be loosened only with the assistance of a rotation motor of the drilling machine.

In order to solve this, e.g. an operator may end the drilling by letting the impact device exert the drill string to impacts for a short while without pressing the drill string against the rock being drilled in order to loose the joints. Whether or not this is successful may depend on the skills of the operator. This procedure, which may be harmful to components of the drill rig, may be performed for longer than necessary periods of time.

According to the invention such problems may be mitigated by a system and method where the state of the joints in regard of whether they are loose or tight may be accurately estimated, and utilised during drilling as well as when loosening the joints prior to retracting the drill string.

The determination of the state of a joint is performed by estimating a force exerted on the at least one joint by the incident wave generated by the impact of the percussion element and further determine a displacement caused by said force when impacting the joint for which the status is being determined. A signal representing the state of the at least one joint, i.e. whether the joint is tight or loose, may then generated using the estimated stiffness. The signal may be used by a drill rig control system in automated drilling, or by an operator that manually controls the drilling control parameters.

The displacement of the joint may be determined by estimating the velocity $v_{thread}$ of the stress wave when propagating through the drill steel, which may be estimated as:

$$v_{thread} = \frac{1}{cp}(\sigma_{inc} - \sigma_{ref})$$

and integrating the velocity of the stress wave, e.g. according to $d=\int v_{thread}dt$.

According to embodiments of the invention, the force acting on a joint because of the incident stress wave may be estimated through a sum of the incident wave and the reflected wave multiplied with a cross sectional area of a component of the drill string, such as the cross sectional area of a drill rod of the drill string.

According to embodiments of the invention at least one of said representation of the incident stress wave and said representation of the reflected stress wave is filtered prior to estimating the stiffness of the joint. In this way, noise in the signals caused e.g. by other reflections in the drill string may be attenuated and/or removed to allow a more accurate estimation of the stiffness of the joint.

According to embodiments of the invention, an offset in said representation of the incident wave and/or reflected wave is removed prior to estimating the stiffness of the joint. The offset may relate to signal levels caused by other reflections in the drill string, and removing the offset may also allow a more accurate estimation of the stiffness of the joint.

According to embodiments of the invention, the stiffness is estimated as a change in force applied by said incident wave on said at least one joint in relation to a change in displacement of the joint caused by said force. This provides a reliable measure of the stiffness of the joint. According to embodiments of the invention it is determined that a joint is properly tightened when a change in force in relation to a change in displacement exceeds a threshold. Conversely, it may determined that a joint is loose when a change in force in relation to a change in displacement is below a threshold.

According to embodiments of the invention, a plurality of thresholds are utilised, so that it may e.g. be determined whether a joint is about to become loose prior to the joint actually have loosened.

According to embodiments of the invention, the estimated stiffness of one or more joints of the drill string are continuously monitored by a drill rig control system, wherein the drill rig control system may adjusting one or more drilling control parameters based on the monitored the estimated stiffness of the at least one joint. Such control parameters may include percussion pressure, feed pressure, feed force, feed velocity, rotation pressure, rotation flow, rotation speed.

The stiffness may be estimated for a plurality, or all, of the joints of the drill string. The generated signal may indicate whether a particular joint is loose, or alternatively whether any or all joints are loose.

According to embodiments of the invention, in a situation when all joints are to be loosened, such as when the drill string is to be retracted from a drilled hole, it may be determined for each joint whether the joint is loose and when all joints are loose a signal indicating that all joints are loosened may be generated. In this way e.g. applying percussions by operator or rig control system may be aborted as soon as the joints are loose so that excessive impacts may be avoided. For example, the rig control system can stop applying impacts to the drill string as soon as it is determined that all joints are loosened.

A state of a particular joint can be determined by estimating when in time the reflection stemming from the particular joint is detectable by the sensor.

According to embodiments of the invention, when the first joint is at a distance from the sensor such that the incident wave is mixed with the reflected wave, the representation of the incident wave may be compensated for the reflection such that the representation of the incident wave is valid also when used for estimation of the stiffness of joints further away from the sensor.

According to embodiments of the invention a first sensor element, such as part of a sensor, or a separate sensor, is used for determining a representation of the incident wave and a second sensor element is used for determining a representation of the reflected wave. A combination of the sensors may also be utilised to determine the incident wave and reflected wave. In this way e.g. the incident wave need not be compensated for a reflected wave even if these coincide in time at the location of the sensor elements.

With further regard to the sensor, a sensor may be utilised which may be in contact with the drill string or a sensor that perform contactless measuring of the stress wave in the drill string using a sensor arranged in the immediate vicinity of the drill string. Such contactless sensors may e.g. operate according to a principle based on measuring changes in the magnetization of the drill string in response to the stress wave travelling in the drill string. A variety of different suitable sensors or sensor combinations of this kind are known to the person skilled in the art of the rock drilling and are therefore not discussed in detail herein.

Further characteristics of the present invention and advantages thereof are indicated in the detailed description of exemplary embodiments set out below and the attached drawings.

DETAILED DESCRIPTION OF EXEMPLARY EMBODIMENTS

Embodiments of the present invention will be exemplified in the following in view of a particular kind of drill rig, where drilling is carried out through the use of a percussion device in the form of a top hammer. The drill rig may also be of any other kind where drilling is carried out through the use of a hydraulic percussion device for transmitting stress waves into a drill tool for breaking rock. The invention is also applicable for drill rigs comprising other kinds of percussive drilling machines than hydraulically driven drilling machines, such as drilling machines operated by electrical or pneumatical means.

Figure 1:
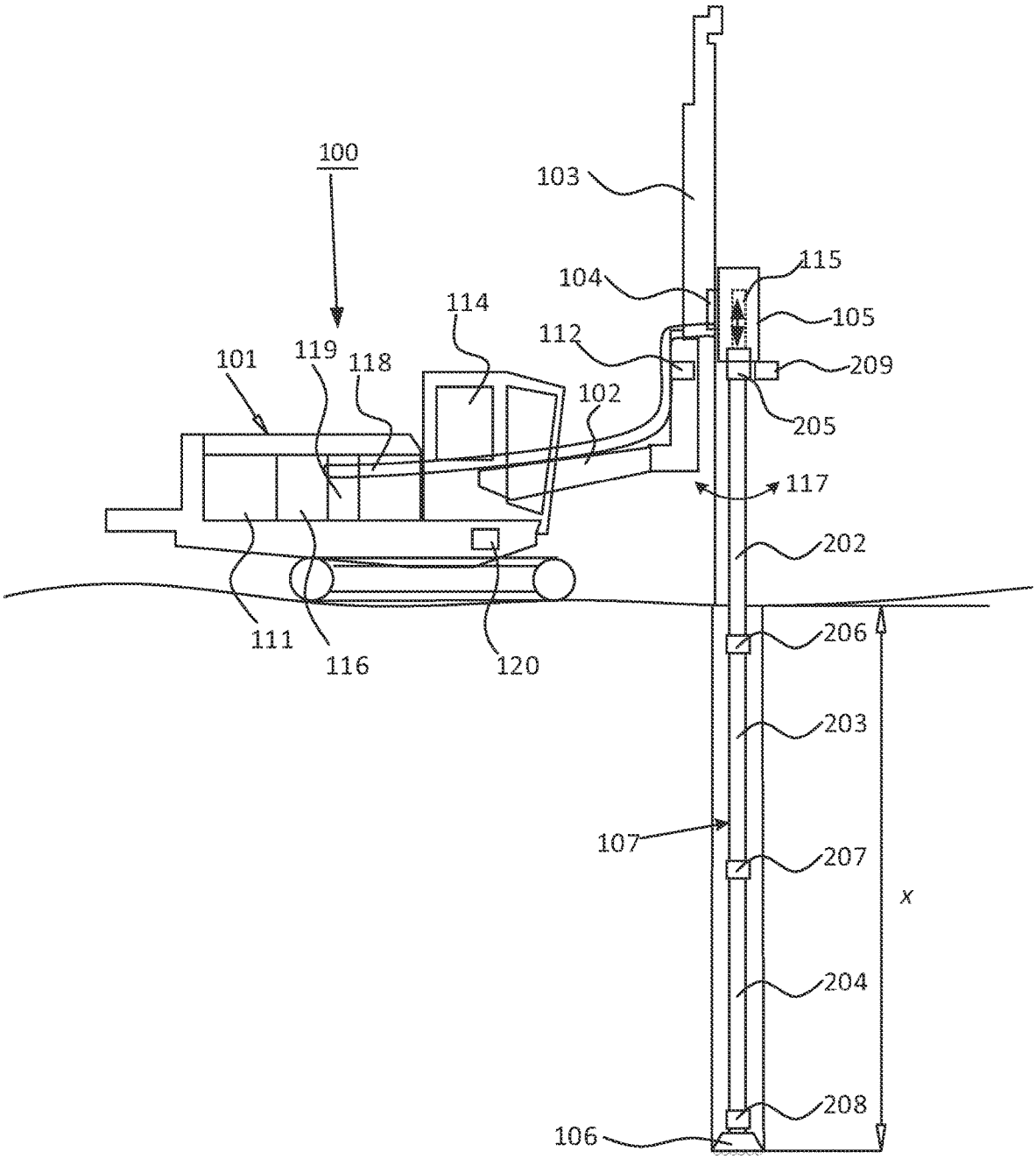
FIG. 1 illustrates an exemplary drill rig in which embodiments of the invention may be utilised.

FIG. 1 illustrates a rock drilling rig 100 according to an exemplary embodiment of the present invention for which an inventive method of determining a status of at least one joint of the drill string will be described. The drill rig 100 is in the process of drilling a hole, where the drilling currently has reached a depth x.

The rock drilling rig 100 according to the present example constitutes a surface drill rig, although it is to be understood that the drill rig may also be of a type being primarily intended e.g. for underground drilling, or a percussive drill rig for any other use. The rock drilling rig 100 comprises a carrier 101, which carries a boom 102 in a conventional manner. Furthermore, a feed beam 103 is attached to the boom 102. The feed beam 103 carries a carriage 104, which is slidably arranged along the feed beam 103 to allow the carriage 104 to run along the feed beam 103. The carriage 104, in turn, carries a percussion device 105 such as a drilling machine, e.g. also comprising a rotation unit (not shown, but the rotation is indicated by 117), which hence may run along the feed beam 103 by sliding the carriage 104.

The percussion device 105 is, in use, connected to a drill tool, such as a drill bit 106, according to the present example, by means of a drill string 107. The drill string may consist of a single drill rod being threaded together with the drilling machine, and to which the drill bit is threaded. This is common e.g. in tunnelling. The drill string 107, however, oftentimes does not consist of a drill string in one piece, but, instead, of a number of drill rods. When drilling has progressed a distance corresponding to a drill rod length, a new drill rod is threaded together with the one or more drill rods that already has been threaded together to form the drill string, whereby drilling can progress for another drill rod length before a new drill rod is threaded together with existing drill rods. This is illustrated by drill rods 202-204, which are joined together by threaded joints 206, 207. The drill bit 106 is joined with drill rod 204 by means of a threaded joint 208. Furthermore, the percussion device 105 comprises a drill shank (see FIG. 2A) on which a percussive element in the form of a percussion piston 115 strikes, and which is connected to drill rod 202 through threaded joint 205. Drill rods of the disclosed kind may be extended essentially to any desired length as drilling progress. When the number of drill rods increases there are also an increasing number of joints that may become loose and cause problems. It is to be noted that the invention is applicable to drill strings having any number of joints.

In use, the percussion piston 115 of the percussion device 105 repeatedly strikes the drill shank and thereby the drill rod in order to transfer shock wave energy to the drill string 107 and thereby the drill bit 106 and further into the rock for breaking thereof. In addition to providing rotation of the drill string, and thereby drill bit 106 during drilling, the percussion device 105, and/or carriage 104, by being subjected to a force acting in the drilling direction, also provides a feed force acting on the drill string 107 to thereby press the drill bit 106 against the rock face being drilled.

According to the illustrated example, the percussion device 105, in particular the percussion piston 115, is powered by pressurised hydraulic fluid being supplied to the percussion device by a hydraulic pump 116 arranged on the carrier 101 and suitable hosing 118. The carrier 101 also comprises a hydraulic fluid tank 119 from which hydraulic fluid is taken and returned to using the hydraulic circuit powering the percussion device. There may be further hydraulic pumps being used to provide pressurised hydraulic fluid in one or more additional hydraulic circuits, such as e.g. a damping circuit (see below).

As is also in general the case, flushing fluid such as e.g. compressed air or a mixture of compressed air and water, or of any other suitable kind, may be led to the drill bit 106 through a channel (not shown) inside the drill string 107, where the compressed air may be supplied to the drill string 107 from a tank in a manner known per se and which is not illustrated herein.

The hydraulic pump 116 and other power consumers such as e.g. compressors and further hydraulic pumps are driven by a power source 111, e.g. in the form of a combustion engine such as a diesel engine or any other suitable power source, such as e.g. an electric motor, or combination of power sources. FIG. 1 also illustrates a sensor 209 being used to measure stress waves being induced into the drill string by the percussion piston 115 and reflections occurring at various locations in the drill string and when the stress wave strikes the rock. As was mentioned above, the sensor 209 may e.g. operate according to a principle based on measuring changes in the magnetization of the drill string in response to the stress wave travelling in the drill string, where various such sensors are known in the art. For example, sensors as exemplified in any of the documents EP 2811110 A1, EP 3266975 B1, WO 2007/082997 A1, U.S. Pat. Nos. 6,640,205 B2, 7,114,576 B2, WO 2017/217905 A1 may be utilised when performing estimations according to the invention.

The rock drilling rig 100 further comprises a rig control system comprising at least one control unit 120. The control unit 120 is configured to control various of the functions of the drill rig 100, such as controlling the drilling process. In case the drill rig 100 is manually operated, the control unit 120 may receive control signals from the operator, e.g. being present in an operator cabin 114 through operator controllable means such as joysticks and other means requesting various actions to be taken, and where the control signals, such as operator inflicted joystick deflections and/or maneuvering of other means, may be translated by the control system to suitable control commands. The control unit 120 may, for example, be configured to request motions to be carried out by various actuators such as cylinders/motors/pumps etc., e.g. for maneuvering boom 102, feeder 103 and controlling the percussion device 105, and various other functions. The described control, as well as other functions, may alternatively be partly or fully autonomously controlled by the control unit 120.

Drill rigs of the disclosed kind may also comprise more than one control unit, e.g. a plurality of control units, where each control unit, respectively, may be arranged to be responsible for monitoring and carrying out various functions of the drill rig 100. For reasons of simplicity, however, it will be assumed in the following that the various functions are controlled by the control unit 120. Such control systems may further utilise any suitable kind of data bus to allow communication between various units of the machine 100. In case the drill rig 100 is maneuvered by an operator various data may be displayed e.g. on one or more displays in the operator cabin 114.

According to embodiments of the invention, the determination of the status of one or more joints of the drill rig is performed by a control unit of the drill rig, such as control unit 120 of FIG. 1, but the determination many also be performed in any other suitable location. Furthermore, as will be explained and exemplified further below, when it is determined that one or more joints of the drill string are loose this may cause the drill rig control system to take suitable action, such as to adjust or stop drilling, and/or provide suitable notification to an operator of the drill rig.

Figure 2A:
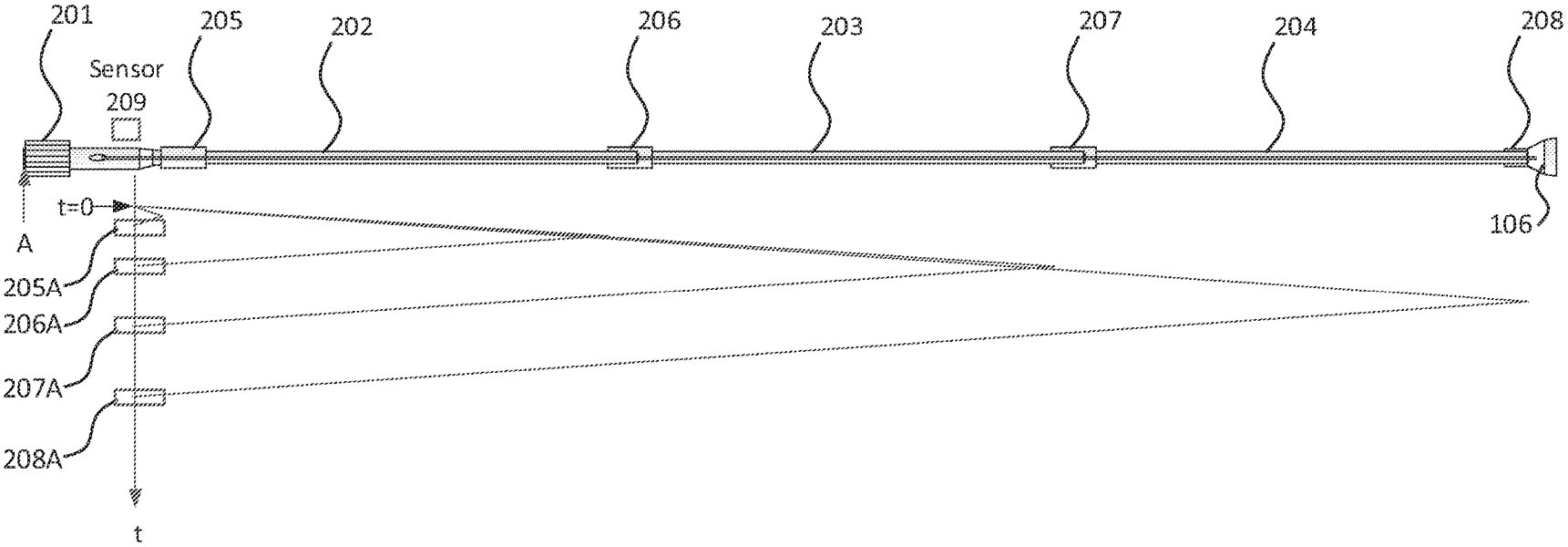
FIG. 2A illustrates the drill string of the drill rig shown in FIG. 1.

FIG. 2A illustrates the drill string according to FIG. 1. The percussion device, i.e. drilling machine is only partially illustrated in the figure illustration of the shank adapter 201 on which the percussion piston strikes in order to induce stress waves into the drill string. The shank adapter 201 is threaded together with the first drill rod 202 through a threaded joint 205. Similarly, as was mentioned above the drill rod 202 is threaded together with a second drill rod 203 through joint 206 etc. and where the drill string is ended by the drill bit 106 which impacts the rock face to break the rock through the induced shockwaves.

As was discussed above, it is crucial that the threads are suitably tightened during drilling to avoid excess wear of the drill string components. A loose joint will also give rise to potentially harmful reflections i.e., a larger part of the induced shockwaves would be reflected at the joint instead of being transmitted to the drill bit and ultimately the rock to be broken. These reflections may be harmful not only to the drill string but also the percussion device and other components of the drill rig. The ability to detect a loose joint during ordinary drilling may reduce such unfavourable situations from being undetected for periods of time. However, as was also discussed above, it is not only during ordinary/regular drilling that the ability of detecting a loose joint may be desirable. When the drilling of a hole is finished, the drill rod is retracted from the drilled hole where, during the retraction, the components forming the drill string are loosened from each other as the drill string is being pulled out. During drilling, however, the joints may become tightened to a degree where rotation/torque that may be applied by the rotation motor will not alone be sufficient to loosen the joints. Therefore, a method is commonly used where the percussion piston repeatedly strikes the drill string in a state where the drill bit does not contact the rock. This is because such procedure may loosen the joints.

An experienced driller may be capable of determining when the repeated strikes on the drill string will have caused all joints of the drill string to be sufficiently loosened such that the drill string may be retracted in a straightforward manner. An inexperienced driller, however, may utilize percussive action for a longer than necessary time with the result that excessive wear may arise and, potentially, the threads may actually be welded together instead of being loosened by the heat that is caused by stress waves acting on already loosened threads. Alternatively, the applied percussive action may not be sufficient with the result that all joints may not be loosened. This may cause problems when retracting the drill string and necessitate that the drilling machine is again connected to the drill string to further loosen the joints.

According to embodiments of the invention, such problems may be mitigated by a system which is capable of determining whether or not the joints of the drill string are either sufficiently tightened for proper drilling or, as the case may be, sufficiently loose to allow proper retraction of the drill string.

This determination may, according to embodiments be performed individually for each joint, and FIG. 2A illustrates on the vertical axis t the elapsed time following a strike on the percussion piston on the shank adapter, illustrated by impact surface A at a time t=0. It is to be noted that time t=0 may also be the time the incident wave reaches the sensor 209, i.e. slightly after the actual initial point of contact between percussion piston and drill shank. As will be illustrated below, both the incident stress wave and the reflected stress wave are detected using the sensor 209. According to embodiments of the invention, however, separate sensors may be utilised for detecting the incident and reflected wave, respectively.

The detected signal is then signal processed according to the below. However, in order to facilitate signal processing, and reduce computations, it is not necessary to process the complete detected signal by the sensor 209 but instead it may be sufficient to process suitable portions of the detected signal. This is illustrated in FIG. 2A, where portions of the detected signals, in the following denoted "cutouts" 206-210 are schematically illustrated. These cutouts are periods of the time about the point in time in which the reflection of a particular joint is expected. For example, the cutout 206A represents the essentially immediate reflection that occurs at the joint 205 where the shank adapter 201 is threaded together with drill rod 202. Similarly, the cut out 206A represents the joint between drill rod 202 and drill rod 203. The cut out 207A represents the joint between drill rod 203 and drill rod 204, and where finally cut out 208A represents the joint of the drill bit 205 to the drill rod 204. In addition to the illustrated cutouts, the incident wave may be measured starting at time t=0. It may, however, be sufficient to measure the incident wave using time window 205A because the joint 205 is very close to the impact surface A.

As is illustrated in the figure, the respective reflections occur at different points in time because of the time it takes for the stress wave to propagate from the impact surface A through the drill string through the drill string and be reflected at the various points of reflection along the drill string and travel back to the position of the sensor 209.

The determination of when in time a particular joint is to be evaluated may be determined in various ways. For example, this can be determined in a straightforward manner through the use firstly of the distance from the sensor 209 to the one or more threads that are to be evaluated. There are a number of parameters that may influence this determination. For example, information such as drill steel length, and the distance to the tip of the thread. Furthermore, the correct steel length, i.e. the distance that the stress wave travels in steel from impact by the percussion piston needs to be known.

Such information, however, is in general stored in the drill rig control system. For example, the length of the shank adapter may be stored. The type of drill rods being used is in general already input into the control system for use in other parts of the drill rig control, where such data may include e.g. the length of the drill rods, cross sectional area and type of steel being used in the manufacturing. The propagation velocity of the stress wave in the steel may be accurately determined through the length of steel, Young's modulus of drill steel and the density of the drill steel. The velocity may also be calibrated using knowledge of the length of the drill steels, which in general is stored in the rig control system, and by analysing the time of arrival of the incident wave and the reflected wave and/or a plurality of reflected waves and secondary incident waves (reflected waves that reaches the drill shank and are reflected again back towards the rock, and so on) from different part of the drill string to determine a time of travel from which the velocity can be determined.

The propagation velocity of the stress wave in the drill string can hence be straightforwardly determined through methods known per se, which also allows a correct determination of time-accurate "cutouts" of the sensor signals of the sensor 209 that are to be used in the determination of the status of the joints according to embodiments of the invention. The lengths of the joints are preferably also taken into consideration when determining the cutouts. The reflection will commence at the tip of the thread and reflection will occur throughout the length of the thread. According to embodiments of the invention, however, cutouts are not utilised but instead the complete signals of the sensor 209 are utilised, where still expected time of arrivals of the various reflections may be determined in the same manner.

The actual processing of the detected/receive sensor signals from sensor 209 in order to determine whether or not a joint is loose will be explained in the following with reference to FIGS. 3-5B. In particular according to embodiments of the invention, a stiffness of the one or more joints being evaluated is estimated.

With regard to the first joint, i.e. the joint 205 where the drill shank is connected to drill rod 202, the reflection from this joint will, according to the present example, reach the sensor 209 prior to the complete stress wave has been induced into the drill string and completely propagated away towards the drill bit 106. This is because the time it takes for the full length of the stress wave to pass e.g. the sensor 209 will depend on the length of the percussion piston, and this time may be longer than e.g. the time it takes for the incident flank of the stress wave to reach the first joint 205 and be reflected back to the sensor 209. Even if this is not the case, this situation may still arise e.g. in dependence of the particular location of the sensor 209. This may in particular be the case when the sensor is located in the vicinity of the joint between drill shank and the first drill rod of the drill string. In case the piston length is stored in the control system, this may be utilised to determine the pulse length of the incident stress wave.

Figure 3:
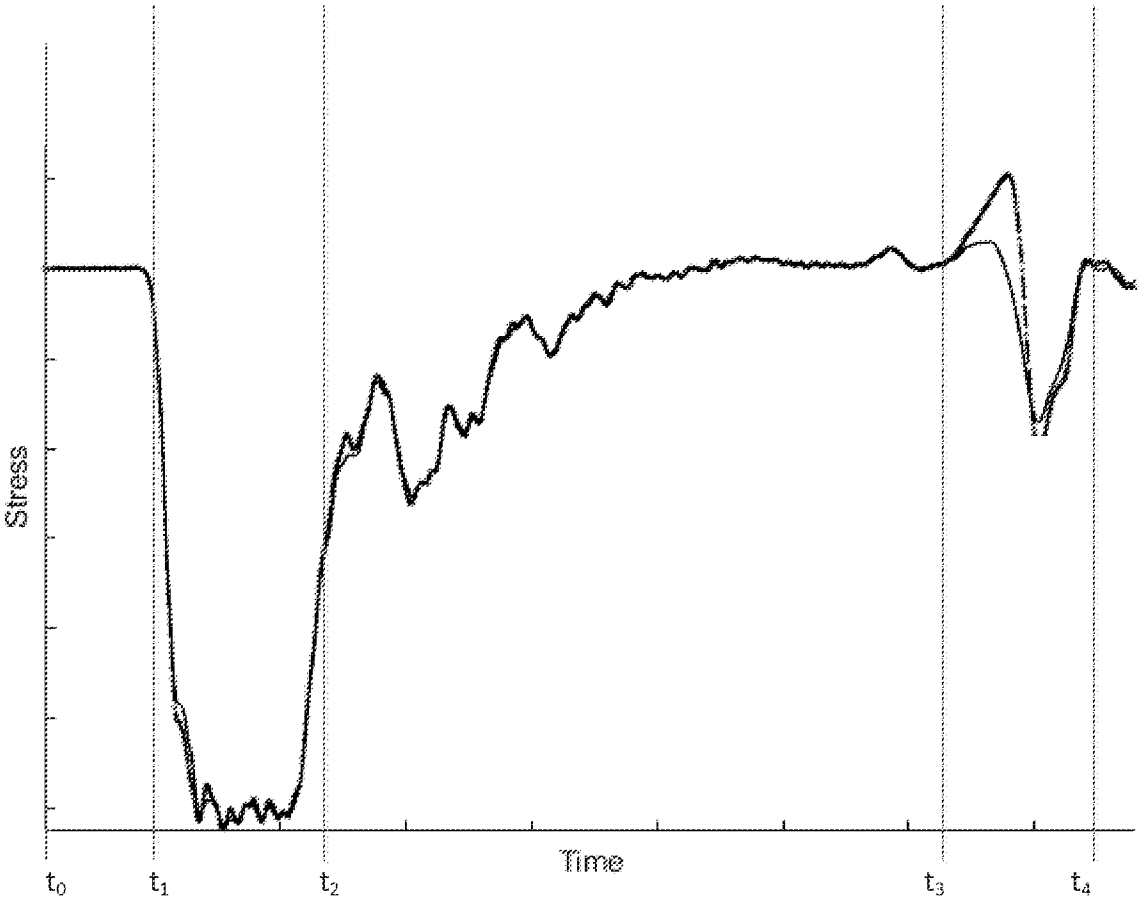
FIG. 3 illustrates an exemplary stress wave measurement relating to the drill string of FIG. 2A.

FIG. 3 illustrates exemplary sensor measurements for a first period of time when a stress wave is induced in the drill string. The percussion piston commences the strike at the drill shank at time to which causes a compression of the drill string. The stress wave will have a length in time essentially corresponding to the time it takes for the stress wave to propagate through the length of the percussion piston 115. This is schematically indicated by time interval $t_1$-$t_2$ in the figure. Between times $t_1$ and $t_2$ there are also reflections caused by the joint between the drill shank and drill rod 202, and which are superimposed on the incident stress wave. The cutout for this joint according to the illustrated example is determined as the time period $t_1$-$t_2$ and hence the same as for the incident wave. This, however, is dependent on the sensor position according to this specific example. It is to be understood that in the general case the incident wave and reflected wave may arrive at the sensor at different or partially or fully overlapping time intervals in dependence of where the sensor is positioned. This will also depend on the length of the drill shank. It may, however, be advantageous to arrange the sensor in the vicinity of the first joint of the drill string. The cutout for the subsequent joint, i.e. joint 206 is determined as the time period $t_3$-$t_4$. Similar assessments can be made for the remaining joints of the drill string (not shown in FIG. 3). The graph of FIG. 3 illustrates stress waves of at least two impacts by the percussion piston. The graph also relates to measurements performed in a lab environment. In real life operation the measured signals are oftentimes considerably noisier. Furthermore, according to embodiments of the invention, a piston impact trigger may be utilised to accurately determine the point in time when the piston strikes the impact surface A to thereby accurately determine the location in time of proper cutouts. According to embodiments of the invention, this may instead be determined from changes in the detected stress wave.

Figure 4A:
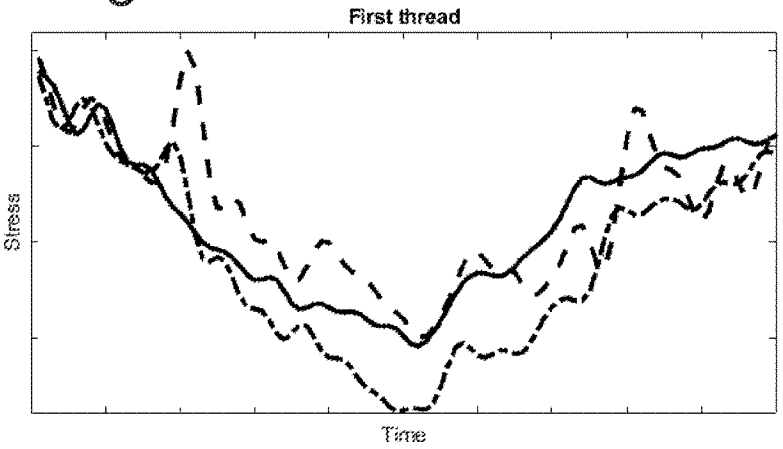
FIGS. 4A-4B illustrates stress wave cutouts for a plurality of percussion piston impacts for two different joints.
Figure 4B:
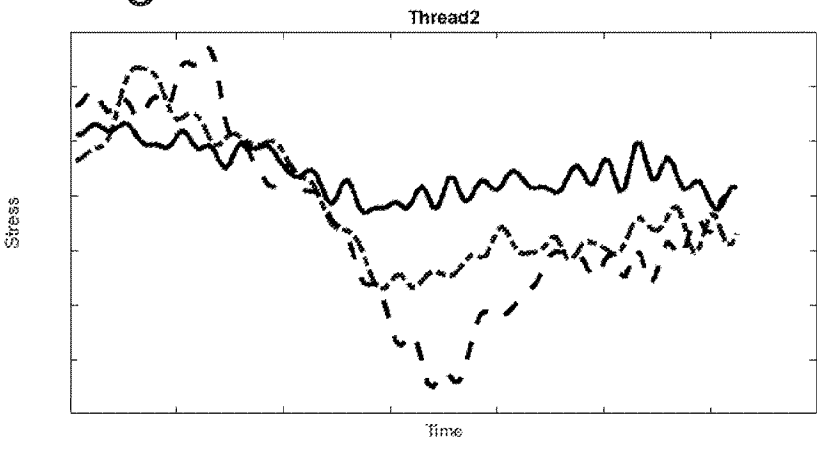

FIGS. 4A and 4B each illustrates three exemplary stress wave measurements, each measurement representing a stroke by the percussion piston. FIG. 4A illustrates cutouts for the first joint, i.e. the joint between the drill shank 201 and drill rod 202 and hence for three different strokes/impacts by the percussion piston. FIG. 4B in a similar manner illustrates cutouts for the second joint, i.e. the joint between drill rod 202 and drill rod 203. In particular, FIGS. 4A and 4B illustrates the measured stress as a function of time for these joints, where the time window has been determined according to the above. The illustrated measured stress waves have already been subjected to some filtering according to the below. The measured signals may in reality be considerably more noisy. It is to be noted that the joints are denoted threads in the figures.

Figure 5:
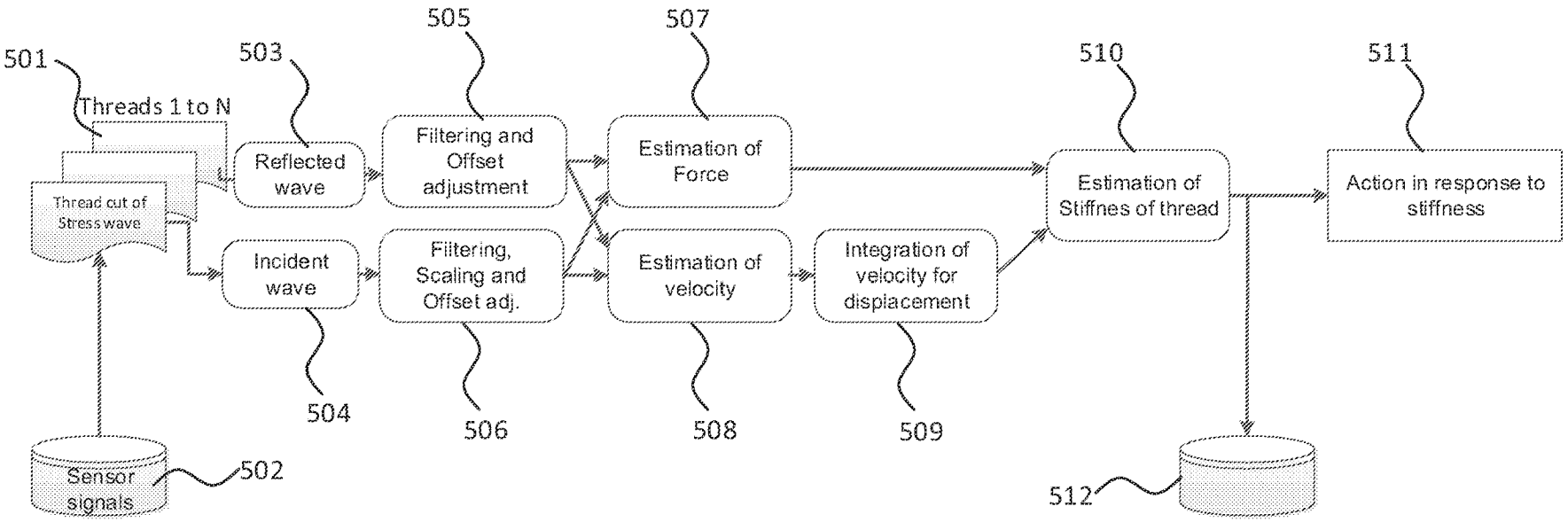
FIG. 5 illustrates an exemplary method according to embodiments of the invention.

FIG. 5 illustrates an exemplary method for determining the stiffnesses of the joints according to embodiments of the invention. As discussed above and illustrated in FIGS. 4A and 4B, a cutout may be performed for each joint of the drill string. These joints may be evaluated either sequentially or simultaneously, i.e. in parallel or when a new cut out has been generated. The evaluations may be constantly ongoing, i.e. the evaluation may be performed for each joint for each stroke (or e.g. for each joint every X strokes) by the percussion piston. The cutouts for the particular threads are illustrated by step 501, where these cutouts may be performed from stored and/or otherwise received signals 502 as measured by the sensor 209. In order to perform the determination, a representation is determined for both the reflected wave, box 503 and as illustrated in FIGS. 4A and 4B, as well as for the incident stress wave is illustrated by box 504. With regard to the incident stress wave, this may be determined through a separate cutout determined by the distance from the impact surface where the percussion piston strikes the drill shank to the position of the sensor 209, or e.g., as in the present example, by the cutout already present by the time period t1-t2, which essentially covers the incident stress wave. This determination is performed for each joint of the drill string that is to be evaluated.

If the first thread is close to the sensor as in the present example, and also loose, the incident wave will be mixed with the reflected wave of the loose joint. This may be compensated for, in particular to obtain accurate results from the joints further down the drill string.

Such compensation can be carried out by adjust the signals to remove the reflection of the first joint, or use a stored reference signal from a same combination of shank and piston when the joint is tightened so that the reflection can be estimated as the difference in relation to this reference. Such reference signals can be determined beforehand and stored in the control system. Alternatively, the reference signal may be stored from a previous impact where the joint has been considered to be tightened. It is also possible to use a sensor, or a sensor combination that is capable of separating the incident wave and reflected wave from each other. This may be performed, for example, by the individual sensors or individual sensor elements of a single sensor measuring the stress waves with an offset so that the incident wave and reflected wave can be solved from the two measurements.

In steps 505, the reflected wave is subjected to filtering and an offset adjustment. With regard to filtering, this may be performed in any suitable manner, e.g. to remove ripples caused by reflections from other lose joints and/or irregularities in the drill string etc. This may, for example, be performed by utilising a moving average filtering, but it may also be performed by filtering in any other suitable way, such as finite impulse response (FIR) filtering and/or infinite impulse response (IIR) filtering. In addition to filtering the reflected wave in step 505, the reflected wave may be subjected to an offset adjustment to remove any offset in the signal that is not caused by the particular reflection being evaluated. This may be performed by subtracting a reference offset or by utilizing a measurement value from the beginning of the cutout time window as reference.

In general, the reference offset may be determined in various different ways. For example, there may be stored in the control system sensor signals representing a stroke on a drill string having the same drill shank and drill bit and possibly drill rods. An offset may be determined and used as reference, where this reference may then be subtracted from the measured signals. Alternatively, or in addition, a sample may be taken in the beginning, such as in the beginning of the stress wave when measurements are made on the incoming wave or at the beginning of the time period for which the analysis is performed. It is also possible to use a reference offset of a previous stroke, i.e. that has been stored when measured for a previous stroke. The signal may be compensated for the offset both before being filtered as well as after the filtering in order to remove any remnant offset following filtering. Furthermore, it may be necessary to take into account whether the first joint, i.e. between drill shank and the first drill rod is loose such that this is compensated for when analysing reflexes of the joint between the first and second drill rod.

Figure 2B:
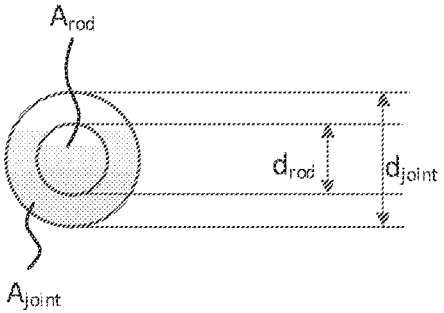
FIG. 2B illustrates cross-sectional areas of a joint of the drill string of FIG. 2A.

In step 506, the incident wave signal is subjected to a similar kind of filtering e.g. also using a moving average filtering or any other suitable kind of filtering. Furthermore, any offset is also removed where this may be determined in a similar manner. The incident wave may also be subjected to a scaling in order to scale the incident wave to a level corresponding to the level of the reflected wave. This scaling may be performed e.g. because the cross-sectional area of the joint may be higher than the cross-sectional area of the drill rod, which thereby has an impact on the level of the reflected wave. This is schematically illustrated in FIG. 2B, which illustrates the differing cross-sectional areas of the joint 206, namely $A_{joint}$ (the cross-sectional area of the joint) and $A_{rod}$ (the cross-sectional area of the rod). A scaling factor $$\frac{A_{joint}}{A_{rod}}$$

may then be applied to the incident wave to obtain proper scaling in relation to the reflected wave.

In step 507 the force that the joint withstands when subjected to the incident wave is estimated, e.g. according to the following equation:

$$F = A_{rod}(\sigma_{inc} + \sigma_{ref}) \quad \text{(eq. 1)}$$

where $A_{rod}$ as stated, is the area of the drill rod. This area in general is known to the control system since the type of drill rod etc. is used in the general control of the drill rig.

$\sigma_{inc}$ is the filtered representation of the incident wave, i.e. the stress wave being introduced into the drill steel by the percussion piston as determined in step 506.

$\sigma_{ref}$ is the filtered representation of the reflected wave from the joint being assessed, and as being determined in step 505.

The representations preferably have a corresponding length in time.

In step 508, the velocity $v_{thread}$ of the stress wave when propagating through the drill steel is estimated, where this estimation of the propagation velocity may be estimated as:

$$v_{thread} = \frac{1}{cp}(\sigma_{inc} - \sigma_{ref}) \quad \text{(eq. 2)}$$

where c is the speed of sound in the drill steel, which may be determined in a straightforward manner, where e.g. Young's modulus of drill steel may be taken into account.

p is the density of the drill steel.

These parameters may be stored in the control system of the drill rig for various drill rods in case parameters vary.

The estimated velocity is integrated in step 509 to obtain a displacement, where the displacement is a measure of the compression (or extension) of the joint when subjected to the incident wave.

$$d = \int v_{thread} dt \quad \text{(eq. 3)}$$

The stiffer the joint is, the smaller will the displacement d be in relation to applied force. The extent to which the joint is compressed, and the force required to accomplish the compression (or extension as the case may be), i.e. longitudinal displacement of the joint, is therefore used to determine a representation of the stiffness of the joint according to embodiments of the invention.

Figure 6A:
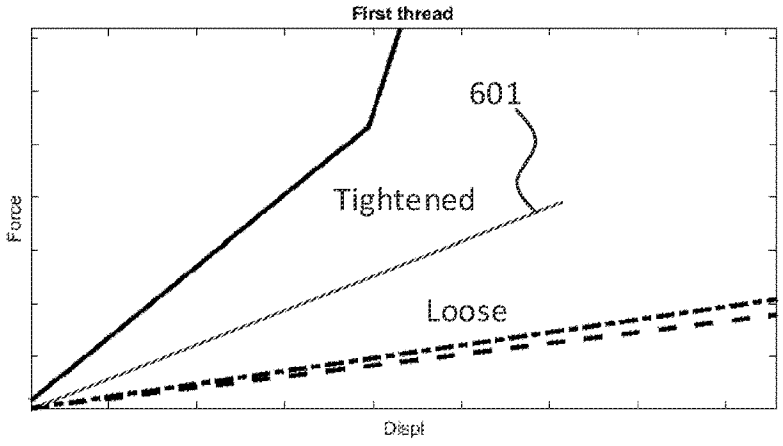
FIGS. 6A-6B illustrates estimated stiffnesses of the impacts of FIGS. 4A-B.
Figure 6B:
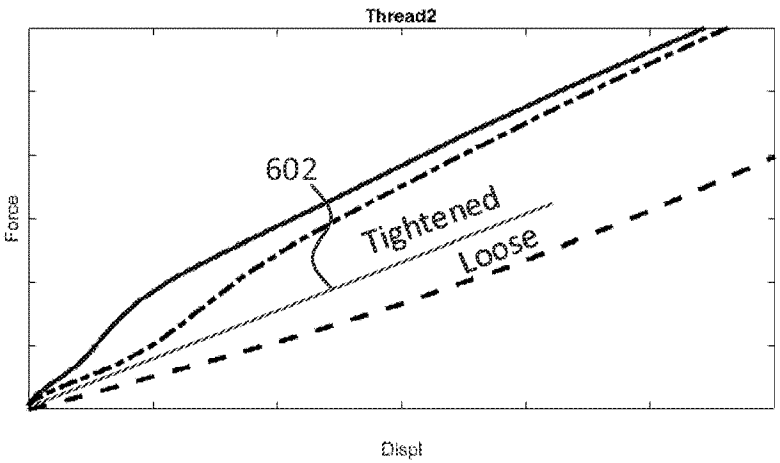

This is illustrated in FIGS. 6A and 6B, where the calculated force is plotted in relation to the calculated displacement. FIGS. 6A and B represents calculated values with regard to the measurements of FIGS. 4A and B, respectively.

The stiffness can hence be determined as the change in increase in force in relation to the concurrent displacement, i.e.

$$\frac{\Delta F}{\Delta d}.$$

For as long as the estimated stiffness exceeds e.g. a threshold $$\frac{\Delta F_{thres}}{\Delta d_{thres}},$$

the joint is determined to be sufficiently tightened.

This is illustrated in FIGS. 6A-B where dashed lines 601 and 602, respectively represents the threshold of $$\frac{\Delta F_{thres}}{\Delta d_{thres}}.$$

A higher stiffnesses than the threshold, i.e. above the threshold line are considered to be sufficiently tightened, while stiffnesses lying below the threshold line are considered to represent loose joints. Hence, with regard to the example of FIG. 6A, the solid line illustrates a stroke where the joint is considered to be firmly tightened, while the dashed line and dash-dotted line are considered loose.

With regard to the example of FIG. 6B, the solid line and dash-dotted line are considered to represent a tightened joint, while the dashed line is considered to represent a loose joint.

When the stiffness of a particular joint, or any joint as the case may be as been determined in box 510 in FIG. 5, this may be indicated in box 511 in any suitable manner to the operator of the drill rig or be used in e.g. automated control of the drill rig. The stiffness of the joints of the drill string may be continuously estimated, such that a signal indicating e.g. presence of a loose joint may be generated anytime this is considered to be required. For example, there may be an indicator, such as a light or other kind of indicator e.g. on a display indicating whether one or more joints are considered to be at least partially lose because the joints exhibit insufficient stiffness.

This may then be used either by the control system in automated drilling or by an operator so that control parameters for controlling the drilling can be automatically or manually adjusted in case deemed necessary. During normal drilling it may be sufficient to indicate if any of the joints of the drill string is considered at least partly lose or such that the operator may take necessary action if necessary. For example, this may include adjusting the drilling control parameters e.g. by increasing and/or decreasing any of the control parameters percussion pressure, feed pressure and rotation pressure.

In case the drill string is to be retracted, there may, instead and/or in addition, be an indicator indicating whether or not all joints are determined to be loosened. The estimation of the stiffness of the joints may also be used in automated drilling where the drill rig control system may adjust drilling control parameters in response to estimations of the statuses of the joints. Similarly, when the drill string is to be retracted the control system may apply percussions to an extent such that the joints precisely are loosened but while simultaneously excessive percussions are avoided.

According to the invention, it is hence provided a method that accurately may estimate the stiffness of a joint using reflected waves that may be very difficult to analyse in themselves, as is apparent when looking at the curves of FIGS. 4A-B, even when these curves have been subjected to filtering and removal of offsets.

According to the above example, the determination has been performed as an estimation whether the joint is either tightened or loose. According to embodiments of the invention, the presentation to user or control system control may also be e.g. a number of loose threads per a particular number of impacts, e.g. expressed as a percentage. The determination according to the invention may be arranged to be commenced as soon as drilling commences. Results form the estimation of the status of the joints may also be stored e.g. in a storage 512 e.g. to allow use of historical data.

The invention also allows that different thresholds of the change in increase in force in relation to the displacement. This may be used to detect whether one or more joints are about to become loose, such that proper actions may be taken prior to the joint actually has become loose. Furthermore, the thresholds may be different for different joints of the drill string.

Figure 7:
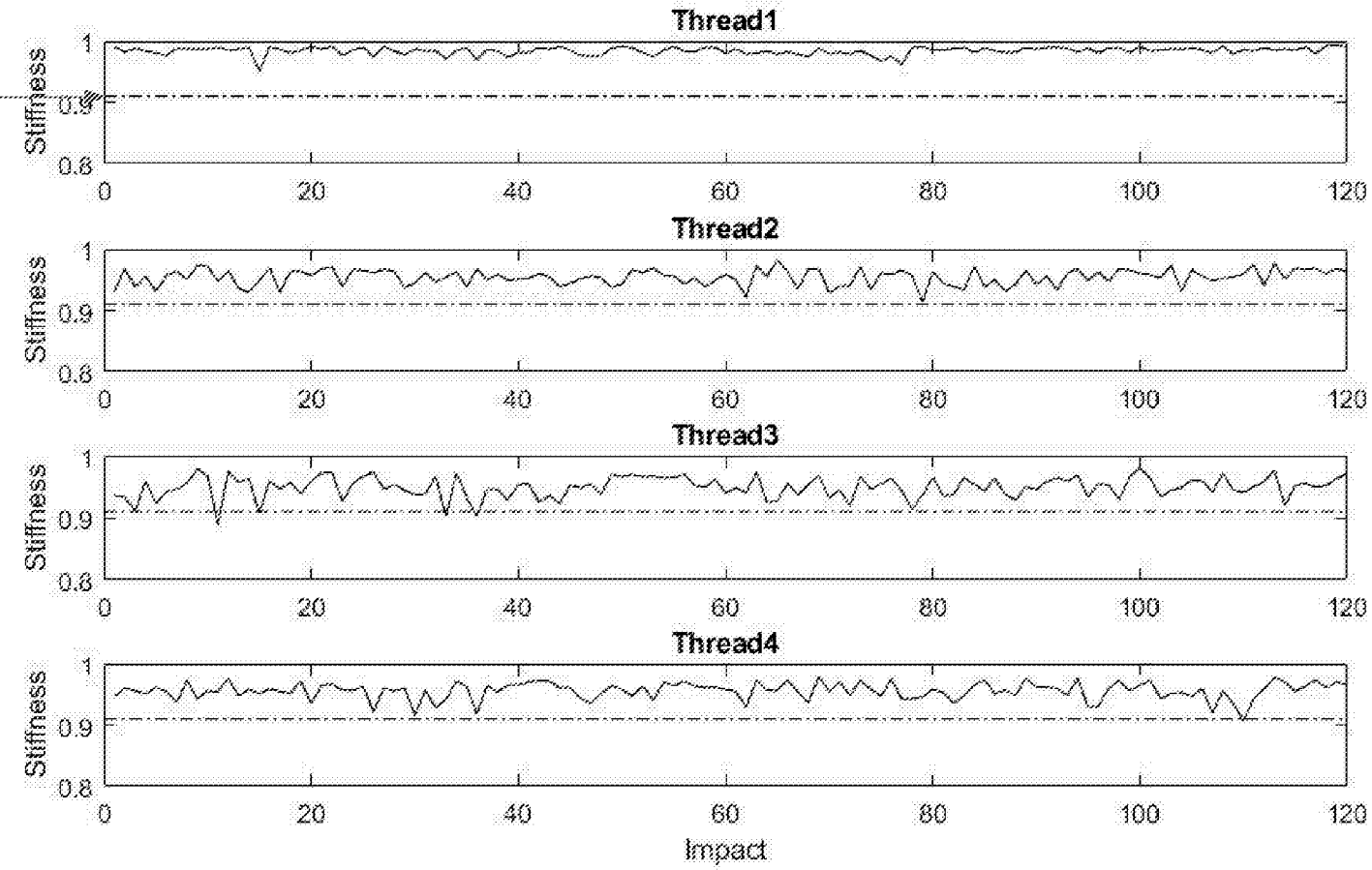
FIG. 7 illustrates an estimation of the stiffness for a plurality of joints for a plurality of impacts.

FIG. 7 illustrates exemplary estimations over time of the stiffness of the various joints (denoted threads in FIG. 7) of FIG. 2A. The figure illustrates estimations for 120 consecutive, or non-consecutive as the case may be, impacts by the percussion piston. Measurements may be arranged to be performed once for each thread for any X impacts. The figure illustrates a level 701 representing the threshold above which the joints are considered to be firmly tightened. As can be seen from the figure, all joints are estimated to be sufficiently tightened throughout the illustrated measurement period.

Figure 8:
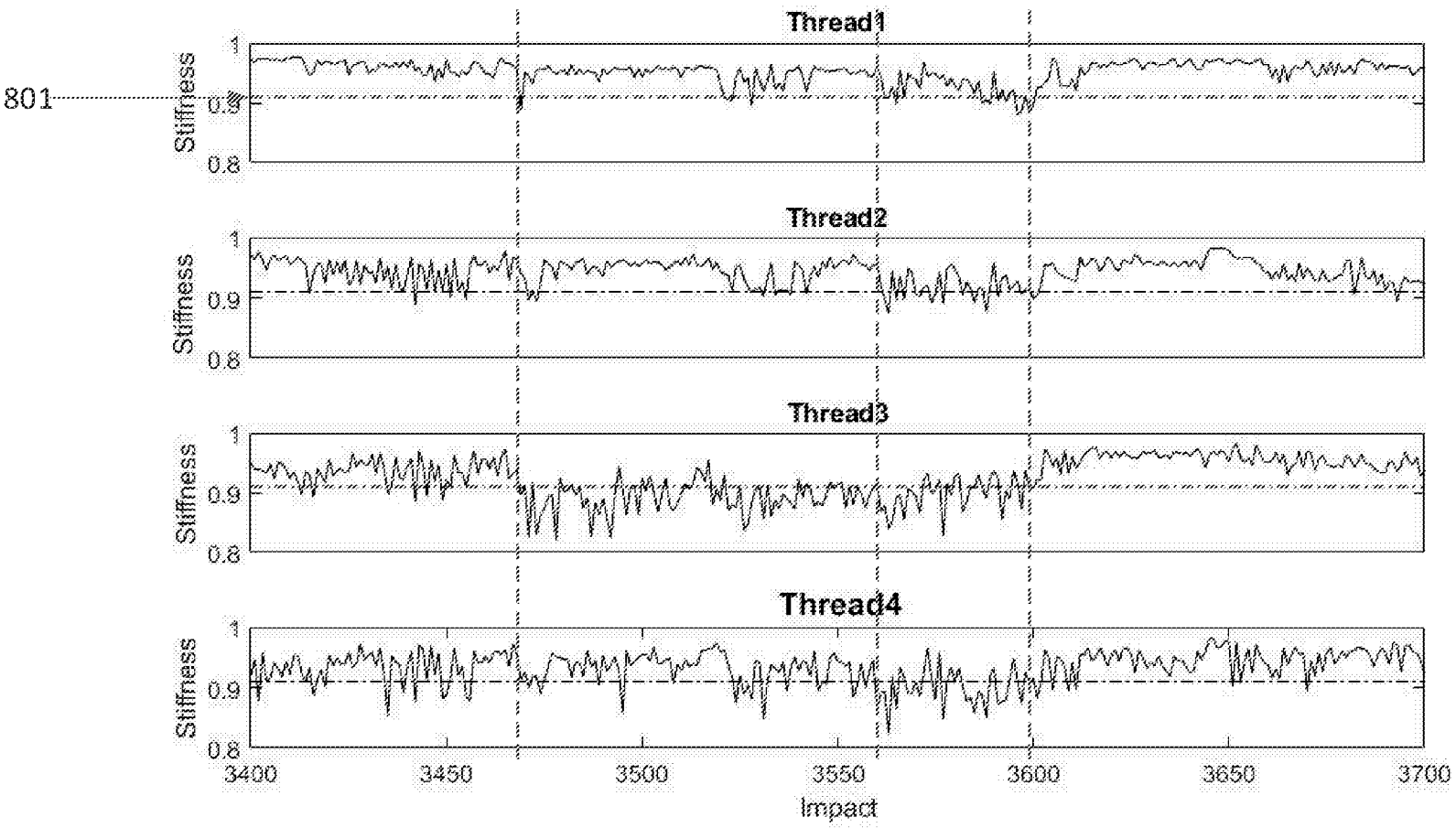
FIG. 8 also illustrates an estimation of the stiffness for a plurality of joints for a plurality of impacts.

FIG. 8 illustrates exemplary estimations over time of the stiffness of the various joints of FIG. 2A in a manner similar to FIG. 7. FIG. 8 illustrates the estimation result of approximately 300 impacts. According to the example of FIG. 8, joint 1 is essentially sufficiently tightened for all the impacts. This is essentially also the case for joint 2, whereas thread 3 is loose for most impacts between impact 3470 and impact 3600, and joint 4 is loose to a large extent between impact 3560 and 3600. From impact 3600 an onwards the joints are tightened for essentially all joints. This may be because the rig control system or operator has adjusted one or more drilling control parameters based on the monitored the estimated stiffness of the joint so that the joints are again firmly tightened. When the rig control system automatically controls the control parameters adjustments may be made followed by immediate estimation of the stiffness such that it can be ensured that properly tightened joints are obtained.

The present invention may be utilised for essentially any kind of drill rig where hydraulic percussive drilling is utilised in combination with joints that may be loosened during drilling. Similarly, the invention is applicable for any other kind of percussion drilling technology. The invention is applicable for underground drill rigs as well drill rigs operating above ground.

The invention claimed is:

1. A method for determining state of at least one joint of a drill string of a drill rig, the drill rig comprising a percussion device that comprises a percussive element for inducing shock waves into the drill string, and a sensor for sensing stress waves in the drill string caused by impacts of the percussive element, the method comprising: when a stress wave is induced into the drill string by the percussive element:

determining a representation of the stress wave caused by the percussive element;

determining a representation of a reflected wave representing a reflection of the stress wave when reaching the at least one joint;

estimating a stiffness of the at least one joint, the stiffness being estimated by estimating a force exerted on the at least one joint by the stress wave and a displacement caused by the force, and generating a signal representing the state of the at least one joint based on the estimated stiffness.

2. The method according to claim 1, further comprising:

estimating the force through a sum of the stress wave and the reflected wave multiplied with a cross sectional area of a component of the drill string.

3. The method according to claim 1, further comprising, prior to estimating the stiffness of the joint:

filtering at least one of the representation of the stress wave and the representation of the reflected wave.

4. The method according to claim 1, further comprising:

prior to estimating the stiffness of the joint, removing an offset in the representation of the stress wave and/or the reflected wave, the offset relating to signal levels caused by other reflections in the drill string.

5. The method according to claim 1, further comprising: estimating the stiffness as change in force applied by the stress wave on the at least one joint in relation to a change in displacement of the at least one joint caused by the force.

6. The method according to claim 5, further comprising: determining the at least one joint to be tightened when a change in force in relation to a change in displacement exceeds a threshold.

7. The method according to claim 1, further comprising: monitoring the estimated stiffness of the at least one joint, and by means of a drill rig control system, adjusting one or more drilling control parameters based on the monitoring of the estimated stiffness of the at least one joint.

8. The method according to claim 1, further comprising: estimating the stiffness of at least a plurality of the joints or all of the joints of the drill string.

9. The method according to claim 1, further comprising, when all of the joints are to be loosened:

by means of the estimation of the stiffness of the joints, determine whether all the joints are loosened, and generate a signal when it is determined that all the joints are loosened.

10. The method according to claim 9, further comprising: by means of a drill rig control system, control the percussive element to apply impacts to the drill string, continuously determining whether all the joints are loosened by means of the estimation of the stiffness of the joints, and stop applying impacts to the drill string when it is determined that all the joints are loosened.

11. The method according to claim 1, further comprising determining state of a particular joint by estimating when in time the reflection stemming from the particular joint is detectable by the sensor.

12. The method according to claim 1, further comprising when a first joint is at a distance from the sensor such that the stress wave is mixed with the reflected wave:

compensating the representation of the stress wave for the reflection such that the representation of the stress wave is valid when used for estimation of the stiffness of the joints further away from the sensor.

13. The method according to claim 1, further comprising: utilising a first sensor element for determining the representation of the stress wave and a second sensor element for determining the representation of the reflected wave.

14. A non-transitory tangible computer-readable storage medium having stored thereon instructions which, when executed by a computer, cause the computer to carry out the method according to claim 1.

15. A system for determining state of at least one joint of a drill string of a drill rig, the drill rig comprising a percussion device that comprises a percussive element configured for inducing shock waves into the drill string, and a sensor configured for sensing stress waves in the drill string caused by impacts of the percussive element, the system is configured to: when a stress wave is induced into the drill string by the percussive element:

determine a representation of the stress wave caused by the percussive element;

determine a representation of a reflected wave representing a reflection of the stress wave when reaching the at least one joint;

estimate a stiffness of the at least one joint, the stiffness being estimated by estimating a force exerted on the at least one joint by the stress wave and a displacement caused by the force, and generate a signal representing the state of the at least one joint based on the estimated stiffness.

16. A rock drill rig, comprising a system for determining state of at least one joint of a drill string of the drill rig, the drill rig comprising a percussion device that comprises a percussive element configured for inducing shock waves into the drill string, and a sensor configured for sensing stress waves in the drill string caused by impacts of the percussive element, the system is configured to: when a stress wave is induced into the drill string by the percussive element:

determine a representation of the stress wave caused by the percussive element;

determine a representation of a reflected wave representing a reflection of the stress wave when reaching the at least one joint;

estimate a stiffness of the at least one joint, the stiffness being estimated by estimating a force exerted on the at least one joint by the stress wave and a displacement caused by the force, and generate a signal representing the state of the at least one joint based on the estimated stiffness.

* * * * *